US009287061B1

(12) United States Patent
Biedunkiewicz et al.

(10) Patent No.: US 9,287,061 B1
(45) Date of Patent: Mar. 15, 2016

(54) ROTOR AND ELECTROMECHANICAL SWITCHING DEVICE HAVING A ROTOR

(71) Applicant: Siemens Aktiengesellschaft, München (DE)

(72) Inventors: Pawel Biedunkiewicz, Berlin (DE); Jörg-Uwe Dahl, Werder (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/854,115

(22) Filed: Sep. 15, 2015

(30) Foreign Application Priority Data

Dec. 2, 2014 (DE) ..... 10 2014 224 622

(51) Int. Cl.
*H01H 1/00* (2006.01)
*H01H 1/20* (2006.01)

(52) U.S. Cl.
CPC ..... *H01H 1/205* (2013.01)

(58) Field of Classification Search
CPC ..... H01H 1/20; H01H 1/2041; H01H 1/205; H01H 73/045; H01H 77/102; H01H 11/00; H01H 3/32; H01H 2235/004; H01H 3/3052; H01H 1/2025; H01H 1/2058
USPC ..... 200/336, 243–250, 400, 401, 275, 17 R, 200/290; 29/622
See application file for complete search history.

(56) References Cited

U.S. PATENT DOCUMENTS 7,189,935 B1 * 3/2007 Hassan ..... H01H 1/205 200/244
8,089,016 B2 * 1/2012 Dahl ..... H01H 1/2041 200/400
9,136,067 B2 9/2015 Bausch et al.
2006/0119455 A1 * 6/2006 Park ..... H01H 77/104 335/16
2014/0061015 A1 3/2014 Biedunkiewicz et al.

FOREIGN PATENT DOCUMENTS

DE 102009052985 B3 7/2011
DE 102013208373 A1 3/2014

* cited by examiner

*Primary Examiner* — Edwin A. Leon
(74) *Attorney, Agent, or Firm* — Warness, Dickey & Pierce, P.L.C.

(57) ABSTRACT

A rotor is shown for an electromechanical switching device, includes: a rotor housing; two contact bridges having in each case two contact portions; an intermediate element disposed between the two contact bridges and mounted so as to be rotatable about a rotation axis; and first spring pins and second spring pins; first spring elements and second spring elements. In an embodiment, the spring pins, the spring elements, and the intermediate element are operationally connected, and at least one of the first and second spring pins is disposed on the intermediate element and/or on the contact bridges such that the spring pin by rotating the rotor is tiltable between the two states in relation to the rotation axis. An embodiment furthermore relates to an electromechanical switching device including the rotor.

12 Claims, 6 Drawing Sheets

ROTOR AND ELECTROMECHANICAL SWITCHING DEVICE HAVING A ROTOR

PRIORITY STATEMENT

The present application hereby claims priority under 35 U.S.C. §119 to German patent application number DE 102014224622.9 filed Dec. 2, 2014, the entire contents of which are hereby incorporated herein by reference.

FIELD

At least one embodiment of the present invention generally relates to a rotor for an electromechanical switching device, having a rotor housing and two contact bridges which are mounted in the rotor housing and which are disposed and mutually spaced apart so as to be rotatable in relation to one another about a rotation axis and in each case have two contact portions, wherein the contact portions by rotating the rotor are movable into an opened state for opening a power circuit and into a closed state for closing a power circuit, and in the closed state are in contact with fixed contact portions of an electromechanical switching device. At least one embodiment of the present invention furthermore generally relates to an electromechanical switching device having such a rotor.

BACKGROUND

Electromechanical switching devices for switching electrical currents are known. One class of switching devices is represented by the so-called circuit breakers. These circuit breakers comprise a housing in which the individual phases of the currents are switched. The individual phases may be accommodated in pole cartridges, which are enclosed by a housing.

Moving and fixed contacts are accommodated in the pole cartridges, which moving and fixed contacts can be separated in order to open a power circuit and brought together in order to close the power circuits. During separation of moving and fixed contacts of a pole cartridge, an arc, which is typically quenched in a so-called "quenching chamber", is formed. Likewise, circuit breakers are known which do not contain any pole cartridges and which accommodate moving and fixed contacts in their housing.

In circuit breakers, it is necessary in order to achieve good current limitation to quickly build up a high arc voltage. This is achieved with so-called "double-breaking interrupters", which split the switching path twice and thus produce simultaneously two arcs in the event of a short circuit. The arc voltage produced by the arc is now present twice in the same time unit, which improves the current limitation in comparison with single-breaking interruption systems. Typically, in the case of these multi-breaking interrupter, two electrical contacts are arranged on a rotatably mounted contact bridges, which contacts represent the moving contacts. The two moving contacts interact with two fixed contacts of the electromechanical switching device so as to open and close the power circuit.

For example, DE 10 2013 208 373 A1 discloses a rotor for an electrical switch, comprising a rotor housing and a contact bridge which is rotatably mounted and which comprises two movable contacts, wherein by rotating the rotor the two movable contacts for closing or opening a power circuit may interact with two fixed contacts of an electrical switch, wherein the rotatably mounted contact bridge in the rotor housing is mounted so as to be movable in a direction which is perpendicular to the direction of the contact bridge in the closed position thereof.

DE 2009 052 965 B3 discloses an electromechanical switching device for in each case one pole of a low-voltage switching apparatus, comprising a rotary contact which is mounted in a rotor housing so as to be movable counter to a spring force and which is composed of at least one rotary-contact body which configures two lever arms, having in each case one lever-arm end, contact pieces being disposed on the mutually opposite lever-arm ends of the rotary-contact body, and in each case comprising fixed contacts which interact with the contact piece of each lever arm, wherein each lever arm is in each case impinged by a spring having a spring body, having in each case one support of a spring at one end on the rotary-contact body and another support at the other end on the rotor housing, wherein the respective support of the spring at one end is established at the at least one rotary-contact body by direct engagement on the rotary-contact body, and wherein both springs are disposed so as to be exclusively on one side of the rotary-contact body.

Double-breaking or multi-breaking electromechanical switching devices, having a rotary design, according to DE 10 2013 208 373 A1 or to DE 2009 052 965 B3, are susceptible to asymmetries. Asymmetry may be a result of the tolerance zone position of the component parts or of asymmetrical erosion during operation, whereby contact portions of the contact bridges may erode in an asymmetrical manner. This asymmetry leads to uneven contact forces and contact resistances at the contact portions and thus to a deterioration in the switching performance and/or in the electrical properties of an electromechanical switching device of this type.

SUMMARY

An embodiment of the present invention at least partly addresses the aforementioned issue in a rotor for an electromechanical switching device or in an electromechanical switching device, respectively. In particular, at least one embodiment of the present invention provides a rotor for an electromechanical switching device and an electromechanical switching device, by which uniform contact forces and contact resistances on the contact portions and thus uniform switching performance may be ensured.

An embodiment of the present invention is directed to a rotor for an electromechanical switching device, and/or an electromechanical switching device. Further features and details of the invention are derived from the dependent claims, the description, and the drawings. It is understood that features and details which are described in the context of the rotor here also apply in the context of the electromechanical switching device and in each case vice versa, such that at all times mutual reference is made or may be made with respect to the disclosure in relation to the individual aspects of the invention.

According to a first embodiment of the present invention a rotor for an electromechanical switching device is provided, having a rotor housing; two contact bridges which are mounted in the rotor housing and which are disposed and mutually spaced apart so as to be rotatable or twistable, respectively, in relation to one another about a rotation axis and in each case have two contact portions, wherein the contact portions by rotating the rotor are movable into an opened state for opening a power circuit and into a closed state for closing a power circuit, and in the closed state are in contact with fixed contact portions of an electromechanical switching device; an intermediate element which is disposed between the two contact bridges and is mounted so as to be rotatable about the rotation axis; a pair of first spring pins and a pair of second spring pins; a pair of first spring elements and a pair of second spring elements, wherein the first ends of the spring elements are fastened to the first spring pins, and the first spring pins are disposed on the contact bridges and on the intermediate element, wherein the second ends of the spring elements are fastened to the second spring pins, and the second spring pins are disposed on the intermediate element, and wherein at least one of the first and second spring pins is disposed on the intermediate element and/or on the contact bridges in such a manner that the spring pin by rotating the rotor is tiltable between the two states, that is to say between the opened state and the closed state, in relation to the rotation axis.

BRIEF DESCRIPTION OF THE DRAWINGS

In the figures, in each case in a schematic manner.

Figure 1:
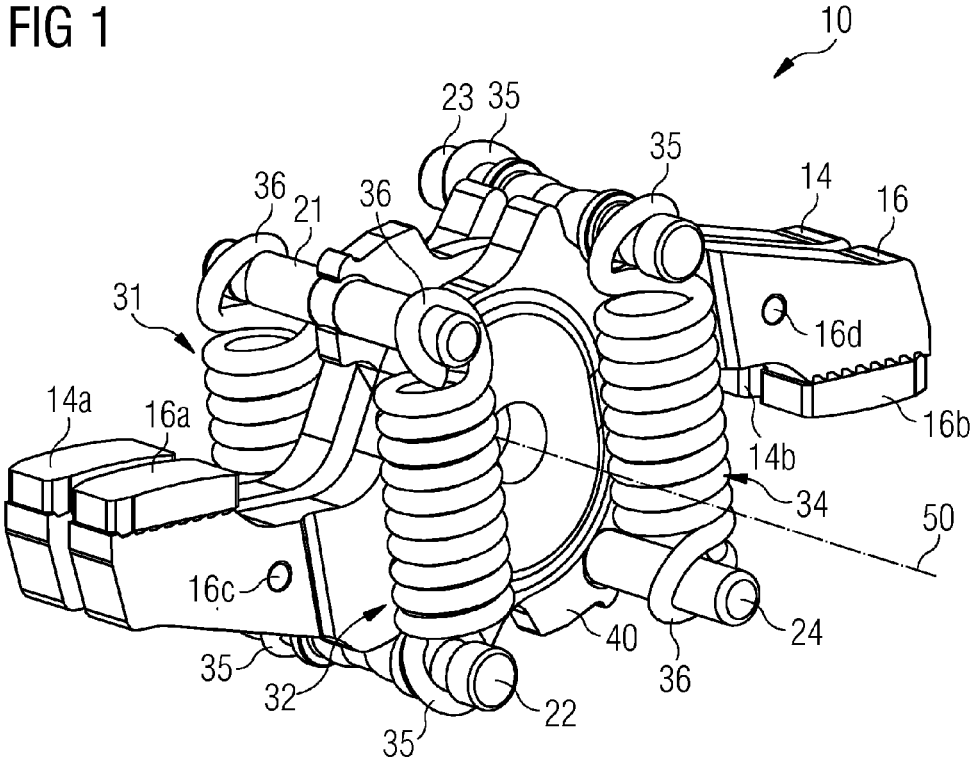
FIG. 1 shows a perspective view of an assembly having two contact bridges, two first and two second spring elements, two first and two second spring pins, and an intermediate element according to a first embodiment of the present invention.

Elements having the same function and mode of operation are in each case provided with the same reference sign in FIGS. 1 to 11.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes,"

and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first embodiment of the present invention a rotor for an electromechanical switching device is provided, having a rotor housing; two contact bridges which are mounted in the rotor housing and which are disposed and mutually spaced apart so as to be rotatable or twistable, respectively, in relation to one another about a rotation axis and in each case have two contact portions, wherein the contact portions by rotating the rotor are movable into an opened state for opening a power circuit and into a closed state for closing a power circuit, and in the closed state are in contact with fixed contact portions of an electromechanical switching device; an intermediate element which is disposed between the two contact bridges and is mounted so as to be rotatable about the rotation axis; a pair of first spring pins and a pair of second spring pins; a pair of first spring elements and a pair of second spring elements, wherein the first ends of the spring elements are fastened to the first spring pins, and the first spring pins are disposed on the contact bridges and on the intermediate element, wherein the second ends of the spring elements are fastened to the second spring pins, and the second spring pins are disposed on the intermediate element, and wherein at least one of the first and second spring pins is disposed on the intermediate element and/or on the contact bridges in such a manner that the spring pin by rotating the rotor is tiltable between the two states, that is to say between the opened state and the closed state, in relation to the rotation axis.

On account of these features of the rotor, a rotor having an optimum equalization of forces between two contact bridges at various tolerance zone positions and states of wear is achieved. The contact forces on the contact portions may be balanced in a particularly advantageous manner. Asymmetric contact resistances are reducible, on account of which uniform erosion between the load side and the connector side is implementable in the electromechanical switching device. It is moreover of advantage that the rotor according to an embodiment of the invention has two contact bridges with a total of four contact portions, on account of which, in contrast to a rotor having only two contact portions, slighter electrodynamic forces are active. On account thereof, components of the rotor, for example the spring pins and/or the spring elements, may be provided so as to be smaller and thus more space saving and more cost effective. Further advantages of a rotor of this type, having two contact bridges in contrast to a rotor having only one contact bridge, include a reduction in the Lorentz forces and a reduction in thermal losses, on account of the increased number of transmission or contact points and of a correspondingly larger overall contact region.

An embodiment of the present invention here is not limited to a rotor having two contact bridges. It is also conceivable for three, four, or more contact bridges to be provided in the rotor. To this end, only correspondingly elongated first and second spring pins, correspondingly more intermediate elements and spring elements, and a correspondingly adapted housing would have to be provided. This means that in an advantageous rotor three or more contact bridges, which are disposed and mutually spaced apart in the rotor housing so as to be rotatable in relation to one another about the rotation axis, having in each case two contact portions may be provided, wherein an intermediate element is then in each case disposed between two contact bridges and mounted so as to be rotatable about the rotation axis.

The electromechanical switching device is preferably configured as a circuit breaker. However, other electromechanical switching devices are also conceivable. The two contact bridges are disposed so as to be parallel or substantially parallel with one another, and in each case have two contact portions. The contact portions are preferably of another material than the remaining contact bridge. The intermediate element is disposed between the contact bridges so as to be parallel or substantially parallel therewith, and is provided as a punched or pressed part, for example. The intermediate element and the contact bridges in the rotor housing are disposed for example on a mounting bolt or on a mounting axle, respectively, so as to be rotatable about an imaginary rotation axis, the imaginary rotation axis not being the mounting bolt or the mounting axle, respectively. The mounting bolt or the mounting axle, respectively, is mounted in the rotor housing. The intermediate element here may indeed be mounted so as to be rotatable about the imaginary rotation axis, but is preferably immovable in relation to the mounting axle or only displaceable in relation thereto in an orthogonal manner.

Additional spacing elements may be disposed between the contact bridges, in order to mutually space the two contact bridges. For example, in each case one spacing element, which retains the spacing to the other contact bridge according to the thickness of the intermediate element, preferably even therebeyond, may be fastened to a contact bridge. The contact bridges are mounted in the rotor in such a manner that a certain contact pressure between the movable contact portions and the fixed contact portions may be ensured in the closed state. The two contact bridges are preferably mutually spaced in such a manner that they are disposed parallel with one another across their entire length or substantially across their entire length in such a manner that they are optionally in mutual contact only by way of the spacing elements. In one design embodiment in which the spacing elements is not a component part of the contact bridges, the contact bridges may also be disposed so as to be mutually spaced apart and parallel with one another in such a manner that they are not in direct mechanical contact at any point.

According to an embodiment of the present invention, the contact portions by rotating the rotor are movable into an opened state for opening a power circuit. However, it is also possible for the contact portions to be movable into an opened position in a self-acting manner, by the effect of electrodynamic forces and without rotating the rotor, for example.

The first and second spring pins are configured so as to substantially be turned parts. This means that, in principle, they have a cylindrical shape having an identical radius throughout or having various radii. However, the first and second spring pins are not limited thereto. In this way, ashlar-formed or prismatic spring-pin portions are for example also conceivable, respectively. The first spring pins here may be mounted on the intermediate element or be in engagement with the intermediate element in such a manner, respectively, that unlatching from the mounting of the spring pins on the intermediate element is prevented in the case of torque reversal. The spring elements are preferably configured as helical springs, in particular as helical control springs. However, the spring elements are not limited thereto. In this way, also volute springs, elastomeric springs, or gas-pressure springs are usable for example. The spring elements here are configured so as to be unipartite or multipartite.

The first ends of the spring elements, that is to say the one ends of the spring elements, are fastened to the first spring pins, and the second ends of the spring elements, that is to say the other ends of the spring elements, are fastened to the second spring pins. The present invention here is not limited to the first and/or second ends of unipartite spring elements being fastened to the first spring pins. The spring elements may for example also be constructed so as to be multipartite, for example from a central resilient element and a fastening device for fastening the spring elements to the spring pins.

The spring elements are preferably fastened to the first and/or second spring pins in a releasable manner. The spring elements together with the spring pins form a form-fitting and/or force-fitting unit, for example. The ends of the spring elements are configured so as to be hook-like, for example, and at least partially encompass the first and/or second spring pins. It is particularly preferable for the spring pins to have clearances in those portions in which the spring elements are fastened thereto, such that the spring elements are inhibited in relation to axial displacement on the spring pins.

For the first and second spring pins to be disposed on the intermediate element means that the spring pins or at least one thereof, respectively, directly or indirectly bear or bears on the intermediate element, respectively, or are or is received by the latter, respectively. Indirectly means that, for example, another lubricant layer or another element which is conducive to the tilting movement of the respective spring pin, for example, may be provided between the respective spring pin and the intermediate element. In this context, received means, for example, that at least one of the spring pins is encompassed by the intermediate element in such a manner that the intermediate element at least in portions surrounds half the circumference of the at least one spring pin. The intermediate element here need not be configured so as to be unipartite or monolithic, respectively, but may also have a separate receiving element which receives the at least one spring pin. In the case of the receptacle of the at least one spring pin on the intermediate element it may furthermore be possible for the spring pin to be tiltable between the two states in relation to the rotation axis by rotating the rotor. The at least one spring pin is not fastened in the receptacle so as to be immovable on the intermediate element. In one preferred design embodiment, the two first spring pins bear on the contact bridges and on the intermediate element, and the two second spring pins are received by the intermediate element in such a manner that the intermediate element at least in portions surrounds half the circumference of the at least one spring pin.

Tiltable here means that the at least one spring pin may be inclined in relation to the rotation axis, while the position of the geometric center thereof does not or does not substantially change.

According to one embodiment of the present invention, at least one of the first and second spring pins, in a portion in which the spring pin is disposed on the intermediate element, in the longitudinal section has at least partly a curved edge.

On account thereof, the at least one of the first and second spring pins is particularly readily tiltable in relation to the rotation axis. The curved edge here is not limited to a curve. In this way, the curved edge may for example also be configured as a V-shaped angle or a substantially V-shaped angle. The curved edge here need not extend across the entire portion but may also be configured in only part of the portion in which the at least one of the first and second spring pins is disposed on the intermediate element. However, the curved edge may also extend beyond the portion.

The explanations relating to the curved edge here apply in an analogous manner to all curved edges which are illustrated in the present application. A longitudinal section is understood to be a section through the at least one of the first and second spring pins which is parallel or substantially parallel with the rotation axis. The at least one of the first and second spring pins, in particular at least one of the two second spring pins, in that portion in which the spring pin is disposed on the intermediate element, has a curvature which in the longitudinal section is for example concave, preferably convex. This may be provided, for example, by a part-bore or a rounded cut-in into one of the second spring pins.

Alternatively, it is also conceivable for example at least one of the second spring pins in that portion in which the spring pin is disposed on the intermediate element to have a spherical surface. On account thereof, the at least one of the second spring pins may be disposed on the intermediate element so as to be particularly readily tiltable, on account of which in turn a particularly advantageous equalization of forces between the two contact bridges is achievable.

Furthermore, according to an embodiment of the present invention, at least one of the first spring pins, in a portion in which the spring pin is disposed on the contact bridges, in the longitudinal section has at least partly a curved edge. On account thereof, it may be ensured that the contact force of the first spring pins is not applied via the edges of the contact bridges but via the end sides of the latter. The at least one of the first spring pins, preferably both first spring pins, in that portion or those portions, respectively, in which the spring pin(s) is/are disposed on the contact bridges, in the longitudinal section has/have for example a convex, preferably a concave curvature. Particularly preferably, the at least one of the first spring pins, in that portion in which the spring pin is disposed on the contact bridges, has a spherical bulge. Alternatively, it is also conceivable for the at least one first spring pin to have a spherical clearance, for example. Moreover, it is conceivable for a bulge or clearance to be configured as a single bulge or clearance on the at least one first spring pin and to extend at least partly across both contact bridges.

It is furthermore advantageous for at least one of the contact bridges, in a portion in which one of the first and second spring pins is disposed thereon, in the cross section to have at least partly a curved edge. This is particularly advantageous in the case of cylindrical first spring pins without a curved edge in the longitudinal section. By way of corresponding molding of the contact bridges, for example a bulge at the end side which runs so as to be orthogonal to the rotation axis or chamfers which are configured on the respective end sides of the contact bridges, respectively, simple cylindrical first spring pins may be used without the contact force of the contact bridges being applied via pointed edges.

Moreover, the intermediate element according to an embodiment of the present invention, in a portion in which one of the second spring pins is disposed thereon, in the cross section may have at least partly a curved edge. The curved edge is preferably configured as a concave or convex curvature. Preferably, the curved edge is configured to be convex in such a manner that the corresponding bulge of the intermediate element fits into the associated concave clearance of the at least one second spring pin in a form-fitting manner. On account thereof, advantageous self-centering between the intermediate element and the second spring pins which are disposed thereon may be implemented. In one advantageous refinement the at least one second spring pin is disposed on the intermediate element in such a manner that the portion of the intermediate element surrounds more than half of the circumference of the at least one second spring pin. To this end, after the at least one second spring pin has been disposed on the intermediate element, for example a lug of the intermediate element may be pushed into the concave clearance of the at least one spring pin in a form-fitting manner, part of the intermediate element being plastically deformed thereby, for example. On account thereof, particularly advantageous axial locking of the at least one second spring pin, that is to say locking in the direction of the rotation axis, may be implemented.

According to a further design embodiment of the present invention, a retaining element, which retains the at least one of the second spring pins in its position in the direction of the rotation axis or substantially in its position on the intermediate element, may be disposed on at least one of the second spring pins. The retaining element is designed, for example, as a bias element, for example a leaf spring. The retaining element here encompasses part of the intermediate element and part of the at least one second spring pin, in particular a depression in the surface of the at least one second spring pin. On account thereof, axial locking of the at least one second spring pin on the intermediate element may be ensured, while the at least one second spring pin remains freely tiltable or pivotable, respectively.

In one refinement according to an embodiment of the invention, at least one of the second spring pins has a main body and a mounting bolt which is insertable into the main body, wherein the mounting bolt is disposed on the intermediate element. On account thereof, a rotor may be provided for which, in the case of wear of that contact face of the at least one second spring pin that is disposed on the intermediate element, a new mounting bolt may be readily provided.

A further advantage of this refinement lies in that various mounting bolts are usable in the same main bodies, on account of which the rotor is modifiable by ready replacement of the mounting bolt. The mounting bolt may be pressed or turned into the main body, for example. The contact face of the mounting bolt on which the latter is disposed, for example in a bearing manner, on the intermediate element is spherical, for example, or has an at least partly curved surface. The mounting bolt may be composed of stainless steel, for example, or of tempered steel, but is not limited thereto. In this way, a mounting bolt of a plastic material is for example also conceivable. The mounting bolt is configured in a pocket or recess, respectively, in the at least one of the second spring pins, for example.

In view of stable mounting of the contact bridges in the rotor housing it is advantageous for at least one of the second spring pins to be mounted in a guidable manner in the rotor housing. To this end, the at least one second spring pin could be guided in long slots, for example, which are configured in the rotor housing. On account of mounting the at least one of the spring pins in the rotor housing, the intermediate element is disposed having slight play, for example on account of the long slots, and so as to be substantially non-twistable in relation to the rotor housing.

According to a further embodiment of the present invention, an electromechanical switching device, having a rotor as previously illustrated, and having at least two fixed contacts, is provided, wherein for opening and closing a power circuit the at least two fixed contacts by rotating the rotor are capable of contacting the contact portions of the contact bridges. This electromechanical switching device is distinguished in particular in that the rotor is configured in the manner according to the invention, on account of which ready equalization of asymmetry between the contact bridges is implementable.

Further measures which improve the invention are derived from the following description of a few exemplary embodiments of the invention, which are schematically illustrated in the figures. All features and/or advantages which emanate from the claims, the description or the drawing, including constructive details and spatial arrangements, may be significant in terms of the invention both individually as well as in the various combinations.

Movable mounting of the spring pins which are required for the application of force is advantageous for optimal equalization of forces in a rotor system having two contact bridges which are disposed in parallel, for example in a low-voltage switch. The contact force is presently generated in that spring elements which are conceived as control springs on the one side act via spring pins on rotatably mounted contact bridges, and on the other side spring pins as counter-bearings for the contact force are disposed so as to be fixed or guided or displaceable in a rotor housing, respectively. In order for optimal balancing of the spring forces to be achieved in various tolerance zone positions and states of wear, secure symmetrical mounting of the spring pins has to be obtained.

FIG. 1 schematically shows the internal construction of a rotor 10 according to a first embodiment. In order to provide improved illustration and explanation of obscured components of the rotor 10, a rotor housing 12 is not illustrated in FIG. 1. The latter is illustrated with reference to FIG. 2 and FIG. 3, for example.

The rotor 10 illustrated in FIG. 1, or the internal construction thereof, respectively, has two contact bridges 14, 16 which are receivable in the rotor housing 12 and are disposed or mounted, respectively, and mutually spaced apart so as to be rotatable about a rotation axis 50. The contact bridges have in each case two contact portions 14*a*, 14*b*, 16*a*, 16*b*, wherein the contact portions 14*a*, 14*b*, 16*a*, 16*b* by rotating the rotor 10 are movable into an opened state for opening a power circuit and into a closed state for closing a power circuit. In the closed state the contact bridges 14, 16 are in contact with fixed contact portions of an electromechanical switching device.

An intermediate element 40, which is likewise mounted so as to be rotatable about the imaginary rotation axis 50 and substantially fixed to a mounting axle or displaceably only orthogonally thereto, is disposed between the two contact bridges 14, 16. The intermediate element here is preferably mounted on the same mounting axle as the contact bridges 14, 16. The intermediate element 40 illustrated in FIG. 1 is in contact with a pair of first spring pins 22, 23, and a pair of second spring pins 21, 24. The first or one ends 35, respectively, of the spring elements 31, 32, 33, 34 encompass the first spring pins 22, 23, on account of which the former are fastened to the latter, and the first spring pins 22, 23 are disposed on the contact bridges 14, 16 and on the intermediate element 40, or bear thereon, respectively. The second or other ends 36, respectively, of the spring elements 31, 32, 33, 34 encompass the second spring pins 21, 24, on account of which the former are fastened to the latter, and the second spring pins 21, 24 are disposed on the intermediate element 40, or are partly received therein or are partly encompassed thereby, respectively.

According to FIG. 1, two spacing elements 16*c*, 16*d* for positively spacing the two contact bridges 14, 16 are disposed on the contact bridge 16. The spacing elements may be inserted in the form of a bolt into a receptacle on the contact bridge, or be provided as a lug which is configured together with the contact bridge 16.

The first and second spring pins 21, 22, 23, 24 illustrated in FIG. 1 at their outer regions have two grooves which encircle the spring pins 21, 22, 23, 24 and in which the first and second ends 35, 36 of the first and second spring elements 31, 32, 33, 34 engage in order for the latter to be fastened to the spring pins 21, 22, 23, 24. Furthermore, the first spring pins 22, 23 between the two grooves have two mounting portions which are configured so as to be substantially spherical and by way of which the two first spring pins 22, 23 bear in a tiltable manner on the contact bridges, more specifically on the end sides thereof. According to the first embodiment illustrated in FIG. 1, the two second spring pins 21, 24, in a portion in which the spring pins are disposed on the intermediate element 40 or bear thereupon, respectively, have an encircling depression which in relation to the second spring pins, when viewed in the longitudinal section, has a concave edge or curve, respectively. On account of this encircling concave clearance, the second spring pins 21, 24 are mounted on the intermediate element 40 in such a manner that the former by rotating the rotor 10 are tiltable between the two states in relation to the rotation axis 50. In the case of unequal erosion on the contact portions 14*a*, 14*b*, 16*a*, 16*b*, this means that the two second spring pins 21, 24 are mounted so as to be tiltable on the intermediate element 40 in such a manner that, on account thereof, the asymmetry caused between the contact portions 14*a*, 14*b*, 16*a*, 16*b* is capable of compensation or equalization, respectively, already with minimum pressure to the contact portions 14*a*, 14*b*, 16*a*, 16*b* in the transition from the opened state to the closed state.

Figure 2:
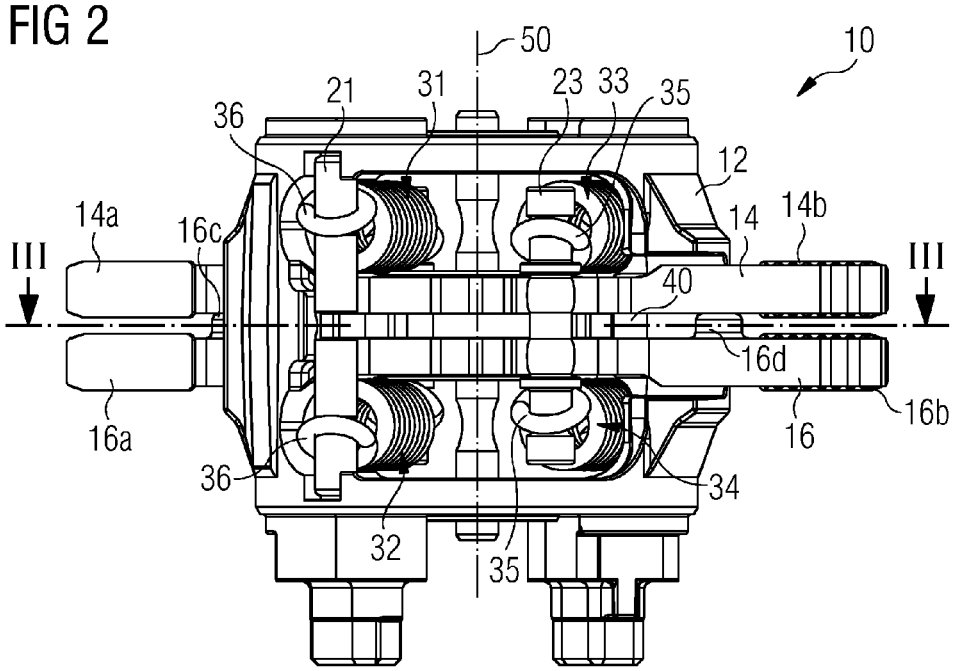
FIG. 2 shows a plan view of a rotor according to the first embodiment of the present invention.

FIG. 2 shows a plan view of a rotor according to the first embodiment of the present invention, having a mounting axle on which the two contact bridges 14, 16 and the intermediate element 40 are mounted. In the first embodiment illustrated in FIG. 2, the mounting axle is mounted in the rotor housing 12. The rotation axis 50 in the longitudinal direction runs through the geometric center of the mounting axle.

Figure 3:
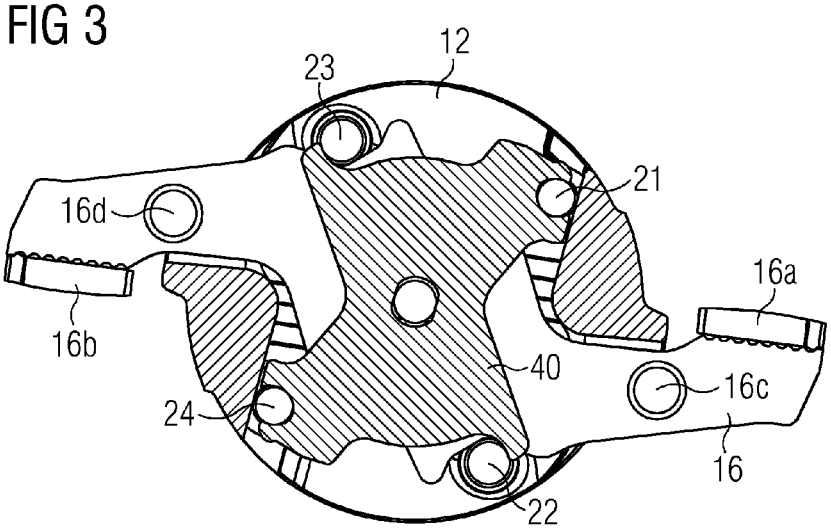
FIG. 3 shows a sectional side view of a rotor according to the first embodiment of the present invention.

FIG. 3 shows a sectional side view of a rotor 10 according to the first embodiment of the present invention, through the sectional plane III-III illustrated in FIG. 2. FIG. 3 here shows in detail how the first and second spring pins 21, 22, 23, 24, in the embodiment shown according to FIG. 3, bear on the intermediate element 40.

Figure 4:
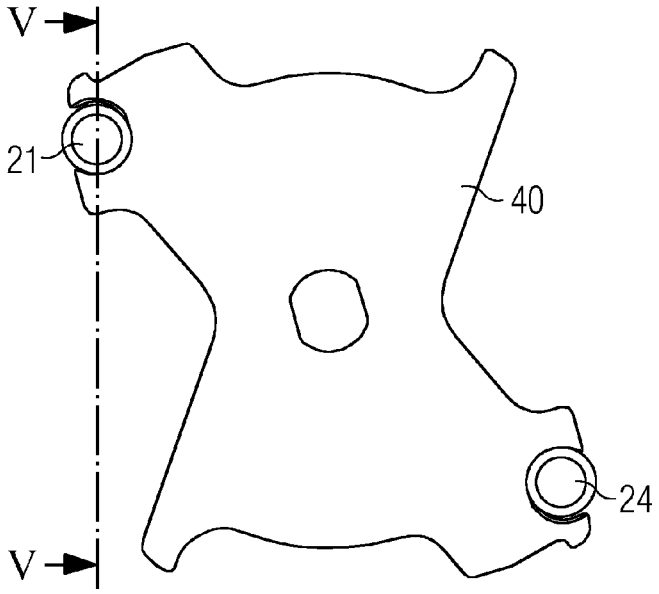
FIG. 4 shows a side view of an intermediate element having two second spring pins, according to the first embodiment of the present invention.

FIG. 4 schematically shows the intermediate element 40, having two second spring pins 21, 24 disposed therein. As can be seen in FIG. 4, the intermediate element 40 does not completely bear on the second spring pins 21, 24. This means that the second spring pins 21, 24 are disposed with certain play in the intermediate element 40. This play may be adapted or modified arbitrarily, respectively.

Figure 5:
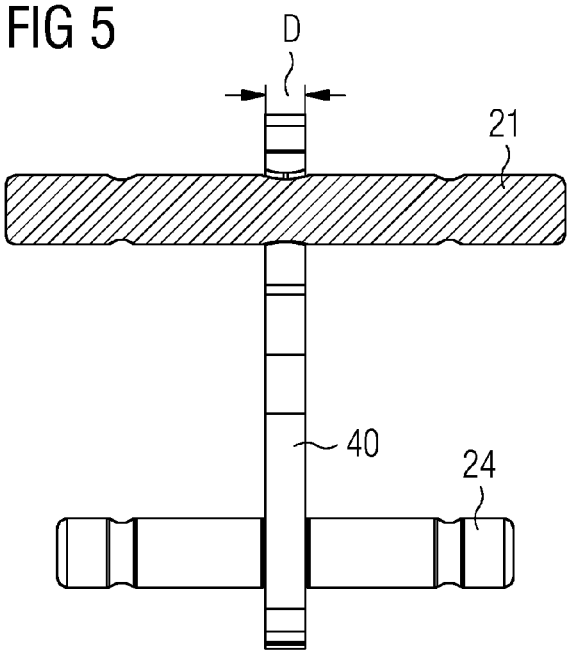
FIG. 5 shows a sectional front view of the intermediate element having the two second spring pins, according to the first embodiment of the present invention.

FIG. 5 shows a front view of the intermediate element shown in FIG. 4, having the two second spring pins 21, 24, according to the first embodiment of the present invention, in a section according to the sectional plane V-V. As can be derived from FIG. 5, the one second spring pin 21 is longer than the other second spring pin 24. The longer second spring pin 21 in an assembled rotor 10, according to the invention is mounted in a guidable manner in the rotor housing 12 (see also FIG. 2 in this context). Furthermore, FIG. 5 shows in detail how a second spring pin, for example the second spring pin 21 in FIG. 5, in a portion in which the second spring pin is disposed on the intermediate element 40, in the longitudinal section at least partly has a curved edge. In FIG. 5 the second spring pin 21 in the longitudinal section, across the entire portion which has a length which corresponds to the thickness D of the intermediate element 40, has an edge which is curved in a concave manner. Accordingly, the intermediate element 40, across the entire portion or the thickness D thereof, respectively, in the cross section which is orthogonal or substantially orthogonal in relation to the longitudinal section of the second spring pin 21, respectively, has an edge which is curved in a convex manner. On account of the bilateral radius, tilting or pivoting of the second spring pin 21, respectively, and automatic centering thereof is enabled. The curved edges in the longitudinal section of the second spring pin 21 or in the cross section of the intermediate element 40 may however also be shorter or longer than the thickness d. This means that the curved edges in the longitudinal section of the second spring pin 21 or in the cross section of the intermediate element 40 may also extend only in part of the afore-described portion or therebeyond.

In order for the second spring pin 21 to be axially locked, it is conceivable for the upper lug of the intermediate element 40 to be pushed into the concave clearance in the second spring pin 21 by way of deformation. This may be achieved, for example, by plastic deformation of the intermediate element 40, for example. According to the present invention it is also conceivable for the upper lug of the intermediate element 40 to be configured so as to be foldable, such that the intermediate element 40 does not need to be plastically deformed when the upper lug is pushed into the concave clearance of the second spring pin. Alternatively, the foldable upper lug may also be provided as another folding element on the intermediate element 40, as a component part thereof, or as a separate component.

Figure 6:
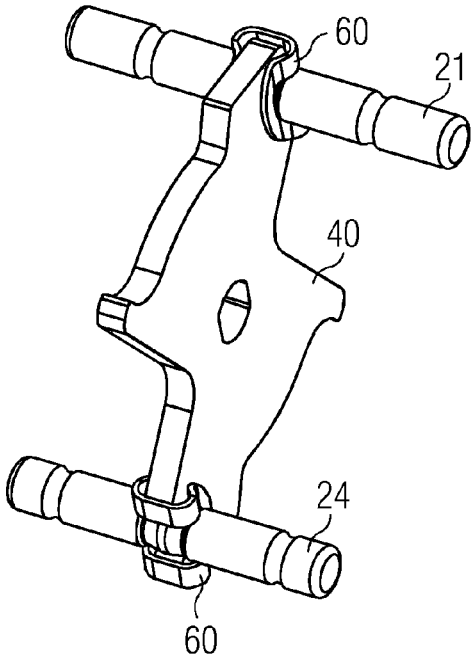
FIG. 6 shows a perspective view of an intermediate element having two second spring pins and two retaining elements, according to a second embodiment of the present invention.

FIG. 6 shows a perspective view of an intermediate element 40 having two second spring pins 21, 24, and two retaining element 60, according to a second embodiment of the present invention. The two retaining elements 60 presently are configured as leaf springs which serve as biasing element, so as to lock the second spring pins 21, 24 against displacement in the axial direction. To this end, the second spring pins 21, 24, in a portion in which the spring pins are disposed on the intermediate element 40, are configured so as to be spherical or substantially spherical. On account thereof, they are not only mounted in the intermediate element 40 in a readily tiltable manner. Moreover, the retaining element 60 may readily engage in the edge between the spherical portion and the remaining cylindrical portion of the second spring pins 21, 24.

Figure 7:
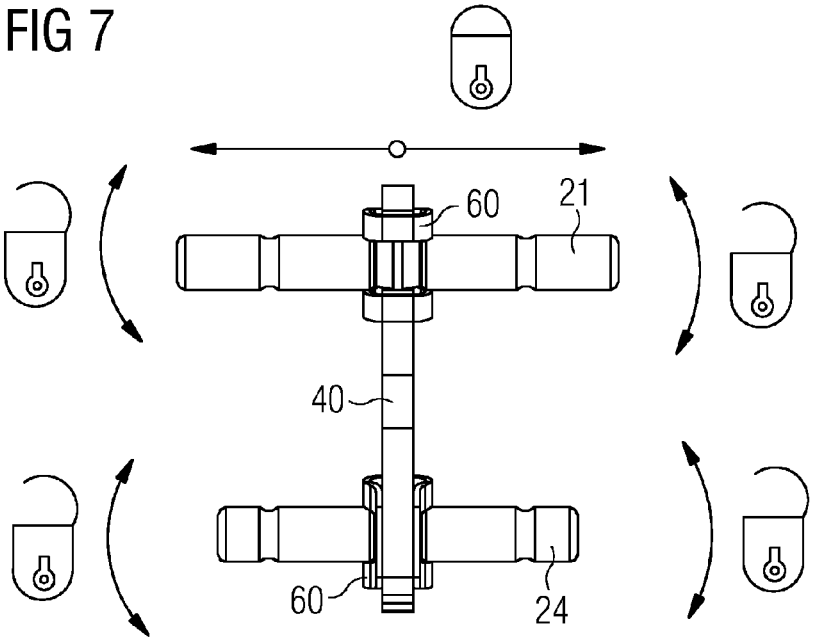
FIG. 7 shows a front view of the intermediate element having the two second spring pins and the two retaining elements, according to the second embodiment of the present invention, in order to illustrate axial locking of the two second spring pins.

FIG. 7 shows a front view of the intermediate element having the two second spring pins 21, 24, and the two retaining elements 60, according to the second embodiment of the present invention, in order to illustrate axial locking of the two second spring pins.

Figure 8:
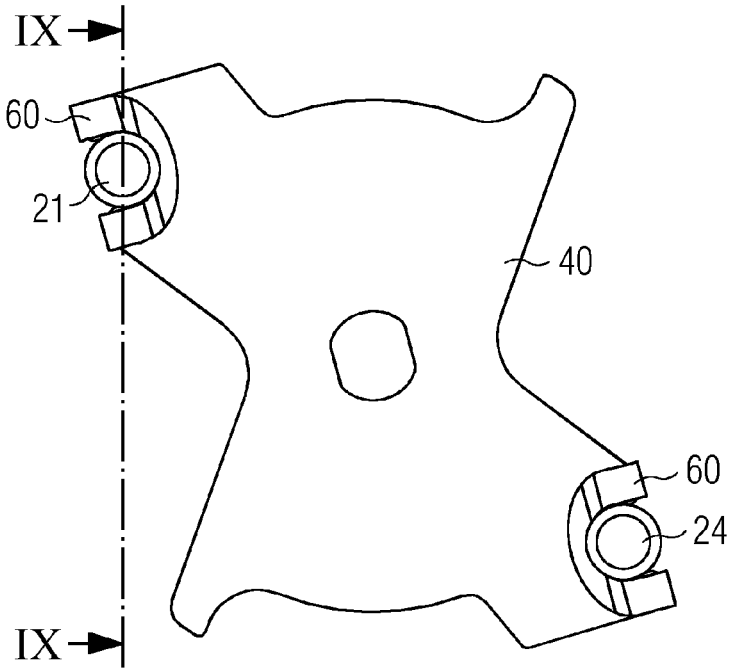
FIG. 8 shows a side view of the intermediate element having the two second spring pins and the two retaining elements, according to the second embodiment of the present invention.
Figure 9:
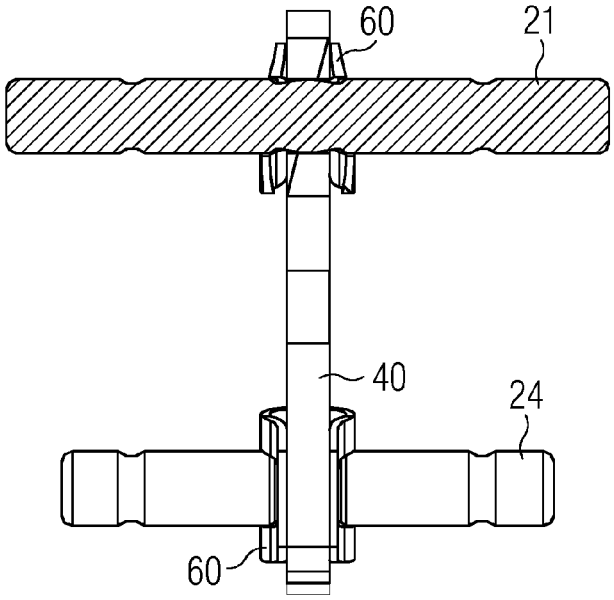
FIG. 9 shows a sectional front view of the intermediate element having the two second spring pins and the two retaining elements, according to the second embodiment of the present invention.

FIG. 8 shows a side view of the intermediate element having the two second spring pins 21, 24, and the two retaining elements 60, according to the second embodiment of the present invention. FIG. 9 shows a front view of the intermediate element 40, having the two second spring pins 21, 24, and the two retaining elements 60, in a section according to the sectional plane IX-IX. As can be derived in particular from FIG. 9, the retaining element 60, for axial locking of the second spring pins 21, 24, engages in an edge or clearance, respectively, which is formed between the spherical or substantially spherical central portion and the cylindrical portions which are contiguous thereto.

Figure 10:
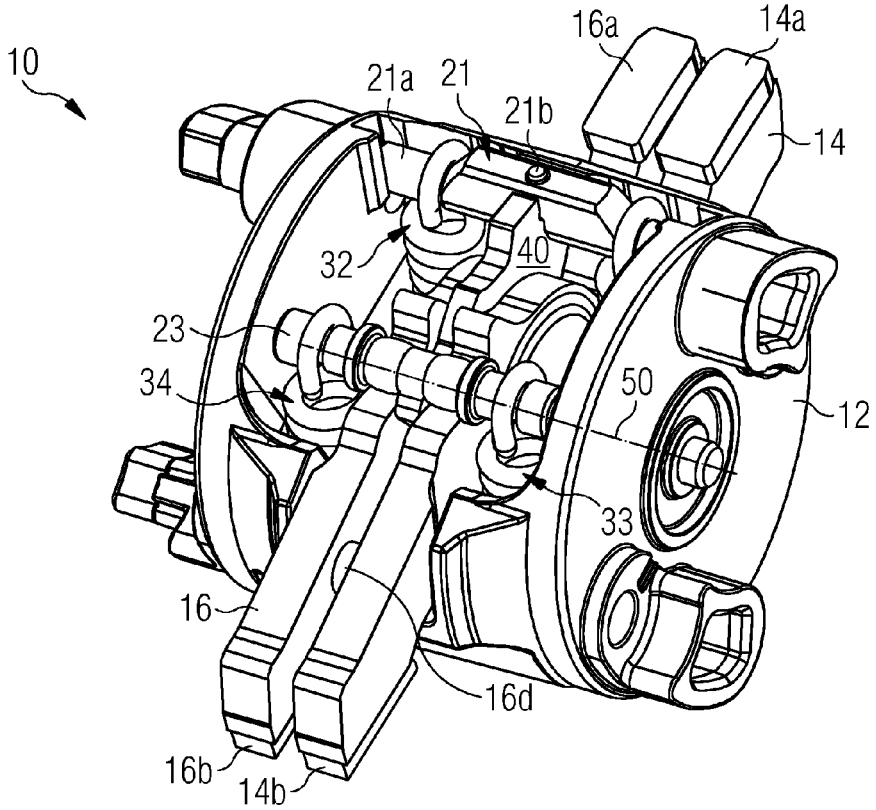
FIG. 10 shows a perspective view of the rotor according to a third embodiment of the present invention.
Figure 11:
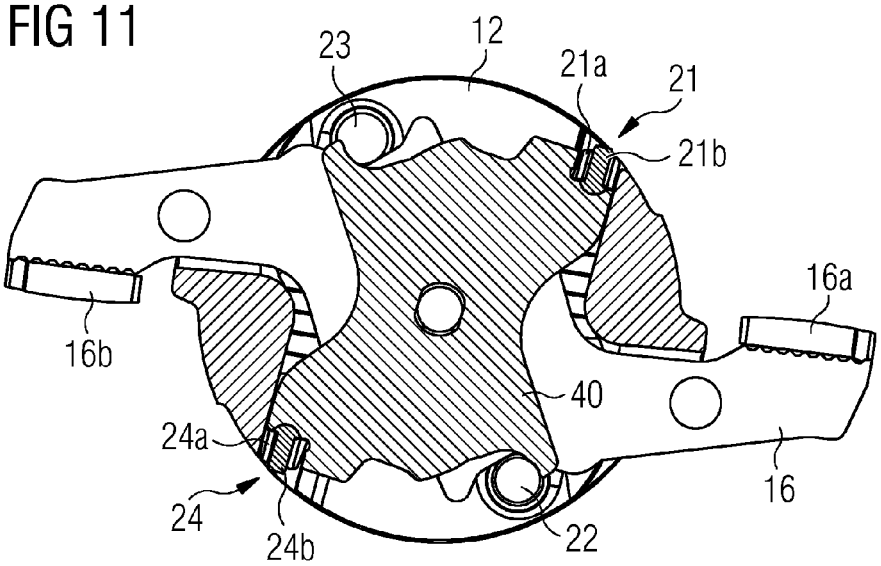
FIG. 11 shows a sectional side view of the rotor according to the third embodiment of the present invention.

FIG. 10 and FIG. 11 show a rotor 10 according to a third embodiment of the present invention. According to the embodiment illustrated in FIG. 10 and FIG. 11, the second spring pins 21, 24 have a main body 21*a*, 24*a*, and a mounting bolt 21*b*, 24*b* which is inserted in the main body 21*a*, 24*a*, wherein the mounting bolt 21*b*, 24*b* is disposed on the intermediate element 40. According to the third embodiment illustrated in the figures, the mounting bolts 21*b*, 24*b* have a conical portion. However, the mounting bolts are not limited thereto. Any arbitrary formed part of metal or plastic material may be used as a mounting bolt. On account thereof, a rotor may be provided for which, in the case of wear of that contact face of the second spring pins 21, 24 that is disposed on the intermediate element 40, a new mounting bolt 21*b*, 24*b* may be readily provided. In this way, various mounting bolts 21*b*, 24*b* may be used for identical main bodies 21*a*, 24*a*, on account of which the rotor 10 is modifiable by simple replacement of the mounting bolt 21*b*, 24*b*. The mounting bolt 21*b*, 24*b* may be for example pushed into, pressed into or turned into the main body 21*a*, 24*a*. The contact face of the mounting bolt 21*b*, 24*b* on which the mounting bolt bears on the intermediate element 40 is configured so as to be spherical for example, or has an at least partly curved surface. The mounting bolt 21*b*, 24*b* illustrated in FIG. 10 and FIG. 11 is configured in a pocket or recess, respectively, in the second spring pins 21, 24. Alternatively, according to the present invention it is also conceivable for the second spring pins 21, 24 illustrated in FIG. 10 and FIG. 11, including the pocket or recess, respectively, and a base-side convex or spherical bulge, respectively, to be provided not in a bipartite manner, but as a unipartite or monolithic component.

LIST OF REFERENCE SIGNS

10 Rotor
12 Rotor housing
14, 16 Contact bridges
14*a*, 14*b*, 16*a*, 16*b* Contact portions
16*c*, 16*d* Spacing element
22, 23 First spring pins
21, 24 Second spring pins
21*a*, 24*a* Main body
21*b*, 24*b* Mounting bolts
31, 32 First spring elements
33, 34 Second spring elements
35 First ends
36 Second ends
40 Intermediate element
50 Rotation axis
60 Retaining element

What is claimed is:

1. A rotor for an electromechanical switching device, comprising:

a rotor housing;

two contact bridges, mounted in the rotor housing and disposed and mutually spaced apart so as to be rotatable in relation to one another about a rotation axis, each of the two contact bridges including two contact portions, the contact portions, by rotating the rotor, being movable into an opened state for opening a power circuit and into a closed state for closing a power circuit, and in the closed state being in contact with fixed contact portions of an electromechanical switching device;

an intermediate element, disposed between the two contact bridges and mounted so as to be rotatable about the rotation axis;

a pair of first spring pins and a pair of second spring pins; and a pair of first spring elements and a pair of second spring elements, wherein first ends of the spring elements are fastened to the first spring pins, and the first spring pins are disposed on the contact bridges and on the intermediate element, wherein second ends of the spring elements are fastened to the second spring pins, and the second spring pins are disposed on the intermediate element, and wherein at least one of the first and second spring pins is disposed on at least one of the intermediate element and the contact bridges such that the spring pin by moving at least one of the contact bridges is tiltable between the two states in relation to the rotation axis.

2. The rotor of claim 1, wherein at least one of the first and second spring pins, in a portion in which the spring pin is disposed on the intermediate element, in the longitudinal section has at least partly a curved edge.

3. The rotor of claim 1, wherein at least one of the first spring pins, in a portion in which the spring pin, is disposed on the contact bridges, in the longitudinal section has at least partly a curved edge.

4. The rotor of claim 1, wherein at least one of the contact bridges, in a portion in which one of the first and second spring pins is disposed thereon, in the cross section has at least partly a curved edge.

5. The rotor of claim 1, wherein the intermediate element, in a portion in which one of the second spring pins is disposed thereon, in the cross section has at least partly a curved edge.

6. The rotor of claim 1, wherein a retaining element, which retains the at least one of the second spring pins in its position in the direction of the rotation axis or substantially in its position on the intermediate element, is disposed on at least one of the second spring pins.

7. The rotor of claim 1, wherein at least one of the second spring pins includes a main body and a mounting bolt which is insertable into the main body, and wherein the mounting bolt is disposed on the intermediate element.

8. The rotor of claim 1, wherein at least one of the second spring pins is mounted in a guidable manner in the rotor housing.

9. The rotor of claim 1, wherein three or more contact bridges, mounted and mutually spaced apart in the rotor housing so as to be rotatable about the rotation axis, are each provided with two contact portions, and wherein an intermediate element is disposed, in each case, between two contact bridges and is mounted so as to be rotatable about the rotation axis.

10. An electromechanical switching device, comprising:

the rotor of claim 1; and at least two fixed contacts, wherein for opening and closing a power circuit, the at least two fixed contacts by rotating the rotor are capable of contacting the contact portions of the contact bridges.

11. An electromechanical switching device, comprising:

the rotor of claim 2; and at least two fixed contacts, wherein for opening and closing a power circuit, the at least two fixed contacts by rotating the rotor are capable of contacting the contact portions of the contact bridges.

12. An electromechanical switching device, comprising:

the rotor of claim 3; and at least two fixed contacts, wherein for opening and closing a power circuit, the at least two fixed contacts by rotating the rotor are capable of contacting the contact portions of the contact bridges.

* * * * *